US005169148A

United States Patent [19]

Wheeler

[11] Patent Number: 5,169,148

[45] Date of Patent: Dec. 8, 1992

[54] GAMING APPARATUS

[76] Inventor: Tad L. Wheeler, 866 Tanglewood Dr., Lafayette, Calif. 94549

[21] Appl. No.: 795,465

[22] Filed: Nov. 21, 1991

[51] Int. Cl.[5] ..... A63F 9/04

[52] U.S. Cl. ..... 273/146

[58] Field of Search ..... 273/146, 147

[56] References Cited

U.S. PATENT DOCUMENTS

| | | | |
|---|---|---|---|
| D. 25,701 | 6/1896 | Patten | 273/146 |
| 244,520 | 7/1881 | Bacon | 273/146 |
| 645,112 | 3/1900 | Mapes | 273/146 |
| 1,419,056 | 6/1922 | Kaufman | 273/146 |
| 1,481,628 | 1/1924 | Souza | 273/146 |
| 1,526,803 | 2/1925 | Miller | 273/146 |
| 1,563,680 | 12/1925 | Zwirner | 273/247 |
| 2,024,541 | 12/1935 | Silkman | 273/146 |
| 3,467,382 | 9/1969 | Leadley | 273/146 |
| 3,608,905 | 9/1971 | Edison | 273/146 |
| 3,794,326 | 2/1974 | Bialek | 273/260 |

FOREIGN PATENT DOCUMENTS

| | | | |
|---|---|---|---|
| 648549 | 12/1928 | France | 273/146 |

OTHER PUBLICATIONS

Chinese Games with Dice and Dominoes by Stewart Culin p. 533, 1895.

*Primary Examiner*—Benjamin H. Layno
*Attorney, Agent, or Firm*—Thomas R. Lampe

[57] ABSTRACT

A set of thirteen dice, each die of the set having four display panels. Each of the display panels carries indicia denoting a card of a standard deck of playing cards. The indicia of each of the four panels of each die denote a card of a suit differing from the suits of the cards denoted on the other three panels of the die and further denote a card of a denomination differing from the denominations denoted on the other three panels of the die.

6 Claims, 2 Drawing Sheets

GAMING APPARATUS

TECHNICAL FIELD

This invention relates to gaming apparatus. More particularly, the invention relates to dice which are of a construction facilitating and allowing their use when playing the game of poker as well as a variety of other card and dice games.

BACKGROUND ART

A wide variety of dice constructions are known in the prior art. A search of the prior art located the following U.S. Pat. No. 3,608,905, issued Sep. 28, 1971, Des. 25,701, issued Jun. 30, 1896, U.S. Pat. No. 244,520, issued Jul. 19, 1881, U.S. Pat. No. 645,112, issued Mar. 13, 1900, U.S. Pat. No. 3,794,326, issued Feb. 26, 1974, U.S. Pat. No. 3,467,382, issued Sep. 16, 1969, U.S. Pat. No. 2,024,541, issued Dec. 17, 1935, U.S. Pat. No. 1,419,056, issued Jun. 6, 1922, U.S. Pat. No. 1,481,628, issued Jan. 22, 1924, and U.S. Pat. No. 1,563,680, issued Dec. 1, 1925.

A number of the dice disclosed in the afore-referenced patents depict playing cards on the sides or panels thereof. For example, U.S. Pat. No. 1,481,628 discloses a dice construction with six sides. U.S. Pat. No. 25,701 illustrates eight-sided dice, U.S. Pat. No. 3,608,905 and U.S. Pat. No. 645,112 dice with 12 sides, and U.S. Pat. No. 1,419,056 dice with 14 sides.

The more individual cards represented on a single die, the more a player is restricted from achieving the full range of poker hands. These restrictions are, in some cases, acknowledged in the prior art patents themselves.

For example, U.S. Pat. No. 3,608,905 states that certain poker hands are not possible with the die construction covered thereby. The unavailable hands include flushes, some three of a kinds and two of a kinds, as well as full houses.

U.S. Pat. No. 1,481,628 also acknowledges that the exact rules of poker games cannot be followed when employing the dice disclosed in that patent since they have only three suits or colors.

A limitation of particular consequence which is inherent in all of the previous dice arrangements of which applicant is aware is the inability of the dice to provide flushes. Also, prior art dice arrangements often do not readily lend themselves for us in games other than poker.

DISCLOSURE OF INVENTION

The present invention relates to gaming apparatus in the form of dice which make available to the player all standard poker hands. These include all pairs, three of a kinds, and four of a kinds. Straights and flushes are possible, along with all full houses, straight flushes, and royal flushes. The dice of the present invention even allow the player to obtain a full suit flush, which is defined as an Ace through King of any one suit. As mentioned above, the obtaining of flushes has been a restriction insofar as prior art dice arrangements are concerned.

The gaming apparatus of the present invention comprises a set of dice, each die of the set of dice having exactly four display panels. Each of the display panels carries indicia denoting a card of a standard deck of playing cards. The indicia of each of the four panels of each die denotes a card of a suit differing from the suits of the cards denoted on the other three panels of the die and further denote a card of a denomination differing from the denominations denoted on the other three panels of the die.

The set of dice comprises thirteen dice, the display panels of the set of dice totalling fifty-two in number and displaying all the cards of a standard four suit, fifty-two card deck of playing cards.

Each die of the set of dice includes a pair of non-planar ends, each of the non-planar ends adjoining the four display panels of the die. The non-planar ends are spaced from one another in opposition to one another, and cooperable with the four display panels to ensure that the die, when thrown onto a flat, unobstructed support surface, will land on one of the display panels and present another of the display panels at the top of the die.

Other features, advantages, and objects of the present invention will become apparent with reference to the following description and accompanying drawings.

BEST MODE FOR CARRYING OUT THE INVENTION

Figure 1:
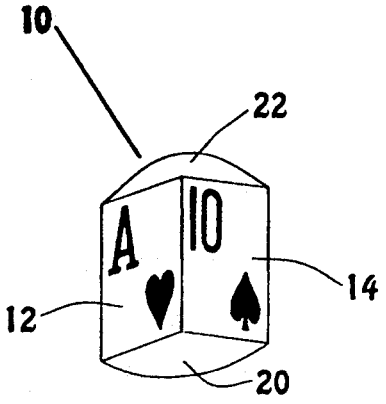
FIG. 1 is a perspective view of a die constructed in accordance with the teachings of the present invention.
Figure 2:
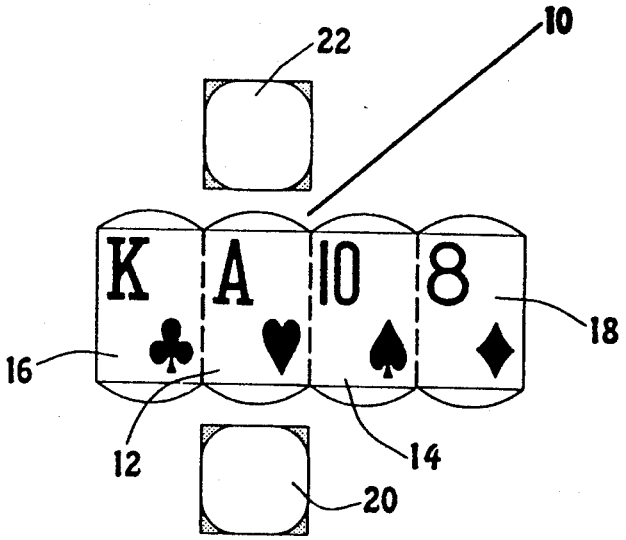
FIG. 2 is a schematic layout of the die of FIG. 1 showing the four panels and rounded ends thereof.

Referring now to FIGS. 1 and 2, a die constructed in accordance with the teachings of the present invention is illustrated and designated by reference numeral 10. The die has four display panels 12, 14, 16, 18. In FIG. 1, an Ace of Hearts is depicted by indicia on panel 12 while the Ten of Spades is depicted on panel 14. FIG. 2 is a diagrammatic presentation illustrating all four of the panels of die 10 as well as the indicia thereon. It ma be seen that panel 16 indicia denotes the King of Clubs while the indicia of panel 18 depicts the Eight of Diamonds.

Die 10 also has rounded ends 20, 22. Rounded ends 20, 22 adjoin the four display panels 12, 14, 16, 18 of die 10, the display panels being of elongated, rectangular configuration and substantially flat. Rounded ends 20, 22 are spaced from one another, in opposition to one another, and cooperable with the four display panels to ensure that the die 10, when thrown onto a flat, unobstructed support surface, will land on one of the display panels and present another of the display panels at the top of the die. The rounded ends are symmetrical about an imaginary axis extending through the middle of the die and substantially parallel to the display panels. The display panels themselves are of identical size.

Figure 3:
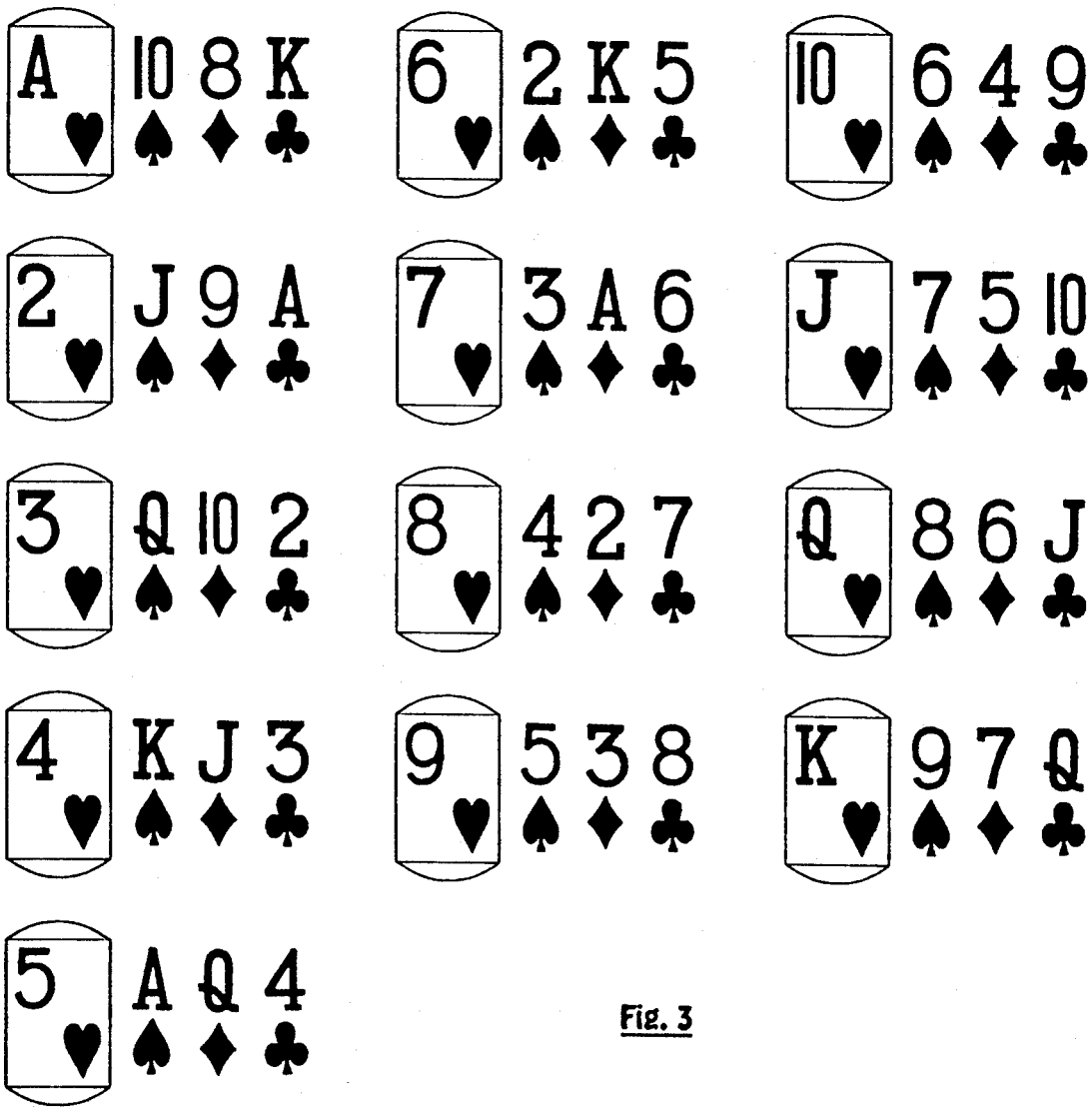
FIG. 3 is an illustration of the complete set of dice of the gaming apparatus in tabular form showing the indicia employed on all four display panels thereof.

The complete set of dice constructed in accordance with the teachings of the present invention comprises thirteen dice which are set forth in tabular format in FIG. 3. It may be seen with reference thereto that with respect to each die the indicia of each of the four panels thereon denote a card of a suit differing from the suits of the cards denoted on the other three panels of the die. Further, the indicia on each of the four panels of each die further denote a card of a denomination differing from the denominations noted on the other three panels of the die.

The complete set of dice comprises thirteen dice, the display panels of the set of dice totaling fifty-two in number and displaying all the cards of a standard four suit, fifty-two card deck of playing cards.

The display panels of each die denote two red suits and two black suits, the red suit display panels being spaced from one another and in opposition to one another and the black suit display panels being spaced from one another and in opposition to one another. This provides for a more even distribution of color on the individual die.

FIG. 3 also points out the fact that the dice of the set of thirteen dice can be arrayed in a predetermined sequence which will present four staggered full suit flushes when the dice are turned. The dice illustrated in FIG. 3 have the suit of Hearts displayed on the presented panels, i.e. the panels facing the viewer. The flush runs from Ace through King. By rotating the dice 90 degrees, the suit of Spades for all of the dice will be presented to the viewer, such suit running from Ten through Nine. With another 90 degree turn Diamonds will be presented (Eight through Seven) and with yet another 90 degree turn Clubs will be on top (King through Queen).

It will be appreciated that modifications may be made to the dice without departing from the spirit or scope of the present invention. For example, while it is preferred that the display panels of the dice are elongated so that they more accurately represent or simulate the proportionate dimensions of regular playing cards, this is not absolutely necessary. Also, the indicia utilized to denote the cards on the display panels may vary from that illustrated. For example, the face cards may be represented with pictures of the Jack, Queen and King.

I claim:

1. Gaming apparatus, said gaming apparatus comprising a set of dice, each die of said set of dice having exactly four display panels, each of the display panels carrying indicia denoting a card of a standard deck of playing cards, the indicia of each of the four panels of each die denoting a card of a suit differing from the suits of the cards denoted on the other three panels of said die and further denoting a card of a denomination differing from the denominations denoted on the other three panels of said die, said set of dice comprising thirteen dice, the display panels of the set of dice totaling fifty-two in number and displaying all of the cards of a standard four suit, fifty-two card deck of playing cards, and the thirteen dice of said set of dice having a predetermined sequence which will present four staggered full suit flushes when the dice are turned.

2. The gaming apparatus according to claim 1 wherein each display panel of all the dice in said set of dice is substantially flat.

3. The gaming apparatus according to claim 1 wherein each die of said set of dice includes a pair of non-planar ends, each of said non-planar ends adjoining the four display panels of said die, said non-planar ends being spaced from one another, in opposition to one another, and cooperable with said four display panels to ensure that said die, when thrown onto a flat, unobstructed support surface, will land on one of said display panels and present another of said display panels at the top of the die.

4. The gaming apparatus according to claim 3 wherein said ends are rounded.

5. The gaming apparatus according to claim 1 wherein said display panels are of elongated, rectangular configuration.

6. The gaming apparatus according to claim 1 wherein the display panels of each die denote two red suits and two black suits, the red suit display panels being spaced from one another and in opposition to one another and the black suit display panels being spaced from one another and in opposition to one another.

* * * * *